US005307934A

United States Patent [19]

Hagner

[11] Patent Number: 5,307,934

[45] Date of Patent: May 3, 1994

[54] BLISTER PACK

[76] Inventor: Hans Hagner, Pfahlberg 18, 7295 Dornstetten, Fed. Rep. of Germany

[21] Appl. No.: 990,884

[22] Filed: Dec. 16, 1992

[30] Foreign Application Priority Data

Dec. 18, 1991 [DE] Fed. Rep. of Germany ..... 9115696

[51] Int. Cl.[5] ..... B65D 73/00

[52] U.S. Cl. ..... 206/471; 206/461; 206/524.8

[58] Field of Search ..... 53/427; 206/461–471, 206/524.8

[56] References Cited

U.S. PATENT DOCUMENTS

| | | | |
|---|---|---|---|
| 3,197,026 | 7/1965 | Gabryel | 206/471 |
| 3,202,278 | 8/1965 | Taylor | 206/471 |
| 3,358,829 | 12/1967 | Smith et al. . | |
| 3,481,101 | 12/1969 | Steadman . | |
| 3,830,365 | 8/1965 | Taylor | 206/471 |
| 3,861,529 | 1/1975 | Coleman . | |
| 4,496,052 | 1/1985 | Nertman | 206/470 |

FOREIGN PATENT DOCUMENTS

| | | |
|---|---|---|
| 1288498 | 1/1969 | Fed. Rep. of Germany . |
| 2622625 | 12/1977 | Fed. Rep. of Germany . |
| 2951226 | 8/1980 | Fed. Rep. of Germany . |
| 963377 | 7/1964 | United Kingdom . |

*Primary Examiner*—Jimmy G. Foster

*Attorney, Agent, or Firm*—Spensley Horn Jubas & Lubitz

[57] ABSTRACT

In a blister pack for packaging an article and composed of a perforated lower plastic backing part and an upper, cut plastic cover part which at least partly surrounds and conforms closely to the article and is connected with the backing part so that the backing part and the cover part completely enclose the article, the backing part and the cover part each including at least a layer made of a single type of plastic and being heat sealed together in a defined area, the backing part and the cover part each constitute a transparent hard foil, and the backing part is provided with perforations of such a size that portions of the cover part engage in the perforations in a manner to plug the perforations in the area where the backing part and the cover part are heat sealed together.

14 Claims, 2 Drawing Sheets

BLISTER PACK

BACKGROUND OF THE INVENTION

The present invention relates to a blister pack, consisting of a perforated lower plastic backing part, or bottom foil, and an upper, cut plastic foil part, or cover foil, the cover foil conforming closely the packaged article placed between the parts and being connected with the backing part all around the article by heat sealing, where the bottom foil and the cover foil are both made of the same type of plastic.

Such a pack is disclosed in German Published, Non-Examined Patent Application DE-OS 26 22 625, and is composed of a foam foil provided as the bottom foil and a single foil or compound foil provided as the cover foil. When using a compound foil as the cover foil, the cover foil layer which faces the foam foil and which is heat sealable as well as the foam foil itself consist of or contain the same basic material, such as polyethylene (PE) or polyvinyl chloride (PCV), in order to achieve good adhesion.

A similar pack is disclosed in German Published, Non-Examined Patent Application DE-OS 29 51 226. Here, too, the cover foil and the bottom foil are made of the same plastic material, e.g. SURLYN TM marketed by E. I. DuPont de Nemours & Co. An information carrier, for example a printed slip of paper, is inserted in an edge area of the pack and has a cover on one side which makes a solid connection with one of the foils, so that this information carrier can be used as a tear strip if it extends past the edges of the two foils.

Disposal of the materials used in blister packs of the type described is an increasing problem.

SUMMARY OF THE INVENTION

It is therefore an object of the invention to provide packs of the above-described type in such a way that simple disposal and minimal use of plastic material and possibly other materials can be achieved.

The above and other objects are attained, in accordance with the invention, by the provision of a blister pack in which the bottom foil and the cover foil consist of a transparent single or compound foil which is hard, i.e. stiff or shape retaining as opposed to a so-called soft plastic, and in which the bottom foil is provided with perforations of such a size that the cover foil engages in these perforations in a cup-like or plug-like manner in the region where the foils are heat sealed.

In connection with the attainment of the object of the invention it has been found, surprisingly, that even with a connection between the bottom foil and the cover foil over a relatively large area, particularly with the use of PET, there is no great shifting or deformation of the edge areas of the two foils which are heat-sealed to each other. This apparently is due to the size of the perforations in the backing foil and the resulting engagement of the cover foil with these perforation.

In the course of study of this blister pack, it has also been found that the shape of such perforations, for example circular or slit-like, does not have a decisive effect as long as this engagement effect is assured. Apparently the form of the cup-like depressions in the cover foil caused by the perforations causes some type of locking or arresting of the two foils with each other, so that satisfactory adhesion of the two foils with each other can also be achieved at those places where a force-locked connection of the two foils solely by heat sealing could not be completely attained.

The three-dimensional structure of the cover foil achieved by means of the cup-like depressions of the cover foil apparently also causes a mechanical stabilizing effect in the sense of the stiffening of the two edge areas of the blister pack formed from the two foils. This has the advantageous result that the foils used (single layer or compound foils) only need to have minimal thickness, which of course results in considerable savings of material, weight and price and therefore also less burdensome disposal. The plastic foil used as the backing part in particular can be made considerably lighter and thinner than the cardboard backings or foam materials used up to now, because sufficient tensile strength is assured in accordance with the attained object of the invention even by very thin plastic foils.

Recycling of the blister pack in accordance with the invention is particularly simplified if the bottom foil and the cover foil both consist of the same material, for example of the same simple foil. With compound foils the same plastic material, such as polyethylene terephthalate (PET), should also be used as the basic material.

During packaging with blister packs in accordance with the invention, an information carrier can be loosely inserted between the bottom foil and the cover foil in a manner such that the information carrier does not adhere to the two foils during heat sealing.

In contrast to already known solutions, where such an information carrier, for example in the form of an information sheet, is connected more or less securely to at least one of the two plastic f oils, this is avoided by the invention in the interest of simple and correct disposal of the pack. When ripping the blister pack open by pulling the two foils apart, the information sheet on the inside is released and can be separated immediately and without great effort from the plastic materials and thus separately disposed of.

As already mentioned, such a blister pack is particularly simple if the same homogeneous plastic material, f or example PET, polystyrene or polypropylene, is used exclusively not only for the backing foil, but also for the upper plastic foil. However, in case of special requirements it is also easily possible to use a compound foil for one or even both foils as long as the layers which face one another and via which the foils are connected together consist of the same plastic material which can be heat-sealed.

An exemplary embodiment will be described in detail with reference to the drawings.

DESCRIPTION OF THE PREFERRED EMBODIMENTS

Figure 1A:
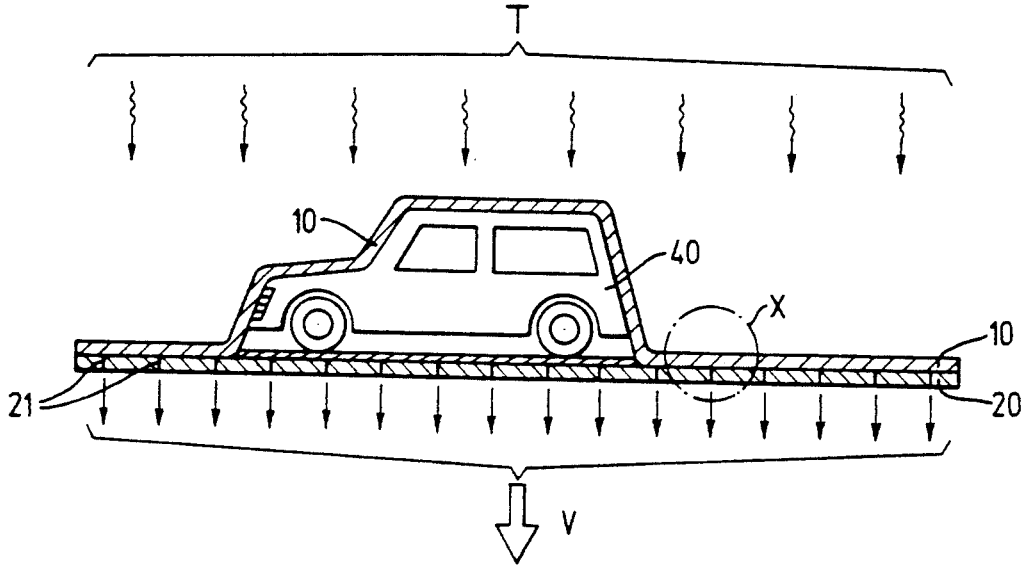
FIG. 1*a* is an elevational cross-sectional view of a blister pack according to the invention.

Referring first to FIG. 1*a*, an article 40 is packaged by being enclosed between an upper plastic cover foil 10 and a plastic bottom foil 20. Foil 20 is provided with perforation openings 21 which assist the vacuum shaping process by which cover foil 10 is made to conform closely to article 40 and to bottom foil 20. The vacuum applied for this purpose during package sealing is indicated symbolically by the downward pointing arrow V. The simultaneous heat applied, possibly simultaneously with the vacuum, for heat sealing is indicated symbolically by arrows T.

Figure 1B:
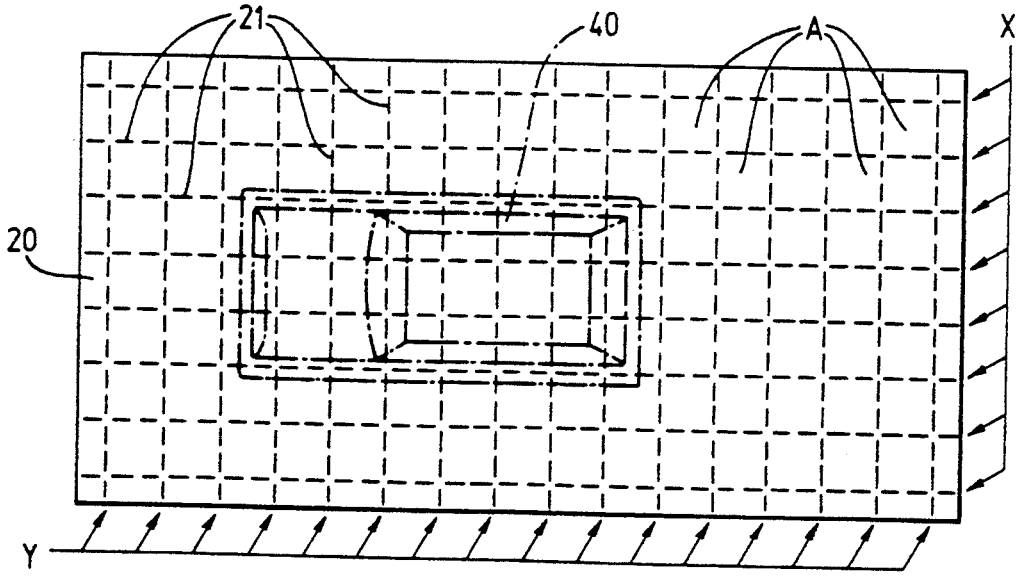
FIG. 1*b* is a bottom plan view of one preferred embodiment of the blister pack shown in FIG. 1*a*.
Figure 1C:
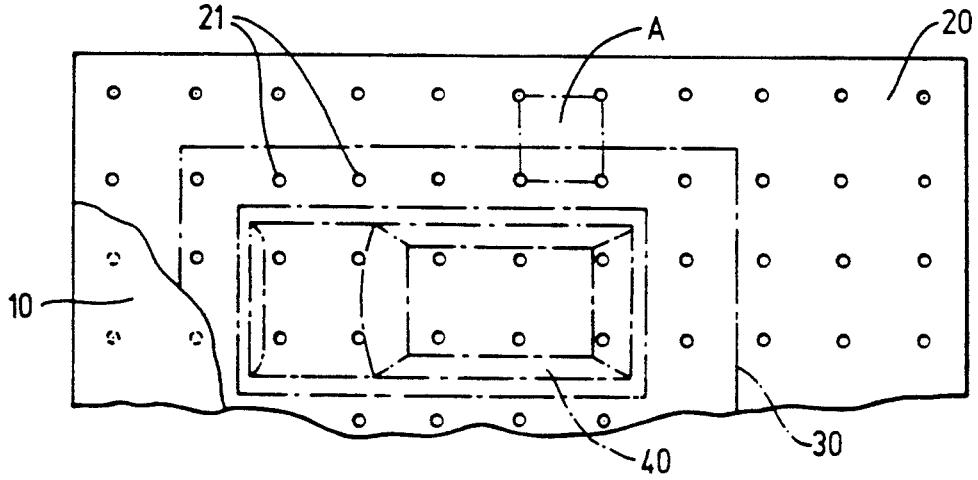
FIG. 1*c* is a bottom plan view of a second preferred embodiment of the blister pack shown in FIG. 1*a*.

The perforation openings 21, which are only schematically shown in the cross-sectional view in FIG. 1*a*, have a fundamental importance not only for effectuating the vacuum shaping, but, in accordance with the invention, also decisively improve the maintenance of the flat shape and the mechanical stability of the two connected foils. In this respect foil patterns, such as are shown in the bottom plan views of FIGS. 1*b* and 1*c*, have proven to be advantageous. In this case the perforation openings 21 are formed as slits, as shown in FIG. 1*b*, or are made circular, as shown in FIG. 1*c*, and are arranged along two mutually perpendicular sets of parallel rows X and Y, so that the perforations delimit square partial areas A each of a size of approximately 1 to 2 $cm^2$. The circular perforations shown in FIG. 1*c* may each have a diameter of approximately 1 mm. More generally, each perforation, whether circular or in the form of a rectangular slit, may have an area of 0.5 to 1 $mm^2$.

During the application of a vacuum, through a support plate (not shown) on which foil 20 rests, portions of upper plastic foil 10 are drawn into the perforation openings 21 and a locking effect is achieved in this way; this locking effect stabilizes the flat position of the foils in their connecting edge areas. This effect can be seen more clearly in the detail view of FIG. 2.

Figure 2:
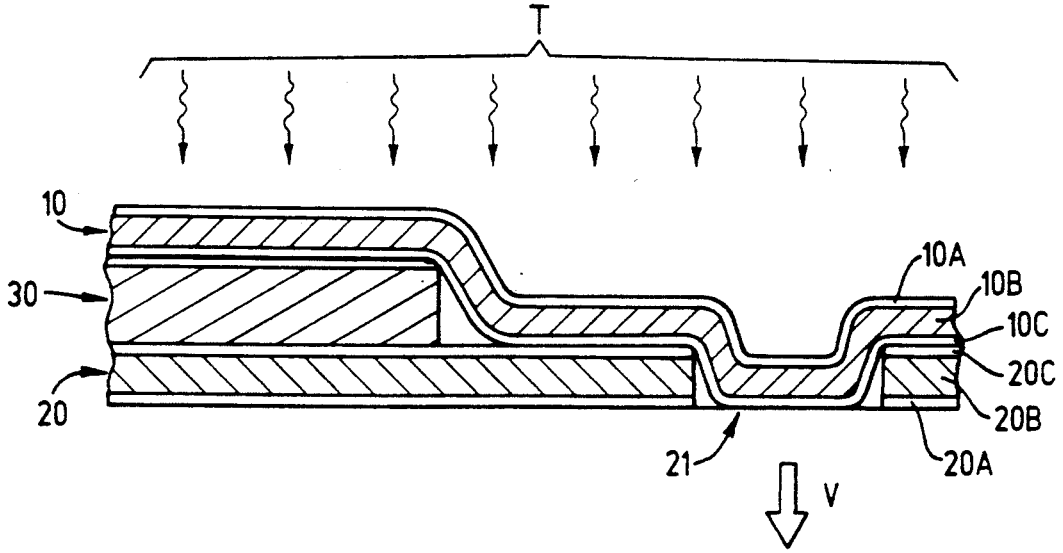
FIG. 2 is a detail view of the region X of FIG. 1*a*.

In the sectional view of FIG. 2, an insert 30, i.e. an information sheet, also shown in FIG. 1*c*, can be seen. It is preferably disposed underneath packaged article 40 and covers a region surrounding article 40 where foils 10 and 20 face one another. In this region, no connection is formed between foils 10 and 20 during heat sealing. Instead, the material of insert 30 is chosen (for example simple paper) , such that information sheet 30 will not be made to adhere to either foil 10, 20 during heat sealing, so that when the pack is opened by pulling the two foils 10, 20 apart, information sheet 30 simply falls out or can be taken out.

The objects of the invention may also be achieved if an edge area of information sheet 30 extends out of an edge area of the two connected foils and in this way is used as a tear strip.

In the same way stamping or similar shapings can be provided in the edge area of the f oil, to permit the entire blister pack to be suspended from a hook at the point of sale.

The foil materials used for a blister pack according to the invention can include an amorphous polymer based on polyethylene terephthalate (A-PET), such as that marketed by Eastman Chemical Products, Inc. under the tradename KODARO® PETG Capolyester 6763, and a thermoplastic polyester such as a condensation polymer produced by a continuous melt-phase polymerization followed by a solid-state polymerization process (S-PET) , one example of which is marketed by Eastman Chemical Products, Inc under the tradename Kodapacke® PET Capolyester 9921 (Clear).

A three-layered compound foil can be made from these two starting materials, where the core of the foil is made from the last-named plastic material (Kodapack PET . . . ), and the outer layers which can be heat-sealed are made from the first-mentioned material (Kodar PETG . . . ). It is possible to produce foils with a thickness of, for example, 150 μ from these starting materials, so that the total thickness of the foil in the edge areas of the blister pack can be around 300 μ or even less, depending on the requirements made on the stability of the pack, which are substantially determined by the material 40 to be packaged.

This application relates to subject matter disclosed in German Application number G 91 15 696.3, filed on Dec. 18, 1991, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. In a blister pack for packaging an article and comprising a perforated lower plastic backing part and an upper, cut plastic cover part which at least partly surrounds and conforms closely to the article and is connected with the backing part so that the backing part and the cover part completely enclose the article, the backing part and the cover part each including at least a layer made of a single type of plastic and being heat sealed together in a defined area, the improvement wherein:

said backing part and said cover part each constitute a transparent hard foil, and said backing part is provided with perforations of such a size that portions of said cover part engage in said perforations in a manner to plug said perforations in the area where said backing part and said cover part are heat sealed together.

2. A blister pack in accordance with claim 1, wherein said backing part and said cover part consist of identical material.

3. A blister pack in accordance with claim 21 wherein said backing part and said cover part are each constituted by a three-layer compound foil composed of a PET layer core and two exterior S-PET layers which can be heat-sealed.

4. A blister pack in accordance with claim 2, wherein said backing part and said cover part are each constituted by a three-layer compound foil which includes an A-PET core layer.

5. A blister pack in accordance with claim 1, wherein said backing part and said cover part each comprise at least one of PET, polystyrene and polypropylene foil material.

6. A blister pack in accordance with claim 1, wherein said perforations have the form of circles or slits.

7. A blister pack in accordance with claim 6, wherein said perforations are circular and have a diameter of approximately 1 mm.

8. A blister pack in accordance with claim 7, wherein said perforations extend along mutually parallel rows.

9. A blister pack in accordance with claim 6, wherein said perforations extend along mutually parallel rows.

10. A blister pack in accordance with claim 61 wherein said perforations lie on at least two groups of rows which form n-cornered partial areas, each partial area being enclosed by perforations.

11. A blister pack in accordance with claim 10, wherein n equals 4.

12. A blister pack in accordance with claim 10, wherein said perforations are circular and each corner of each partial area is delimited by one of said perforations.

13. A blister pack in accordance with claim 1, further comprising a sheet-like information carrier loosely enclosed between said backing part and said cover part, said information carrier having outer surfaces which are not adhered to either one of said backing part and said cover part when said backing part and said cover part are being heat sealed together.

14. A blister pack in accordance with claim 1, wherein said backing part has a lower surface which faces away from said cover part, and the portions of said cover part have surfaces which are substantially flush with said lower surface of said backing part.

* * * * *